US006161602A

United States Patent [19]

Erbs

[11] Patent Number: 6,161,602

[45] Date of Patent: Dec. 19, 2000

[54] UNITARY FINGER JOINT CUTTING BIT AND FINGER JOINT CUTTING HEAD INCORPORATING THE SAME

[75] Inventor: Steven D. Erbs, Janesville, Wis.

[73] Assignee: Wisconsin Knife Works, Inc., Beloit, Wis.

[21] Appl. No.: 09/413,953

[22] Filed: Oct. 7, 1999

[51] Int. Cl.[7] ..... B27M 1/00; B27C 1/00

[52] U.S. Cl. ..... 144/91.2; 144/218; 144/224; 144/225; 144/241; 407/35; 407/41

[58] Field of Search ..... 144/91.2, 136.1, 144/218, 224, 225, 228, 234, 241, 347; 407/33, 35, 40–43, 49, 50

[56] References Cited

U.S. PATENT DOCUMENTS

| | | | |
|---|---|---|---|
| 1,635,732 | 7/1927 | Witt | 144/91.2 |
| 1,718,325 | 6/1929 | Weaver . | |
| 2,540,530 | 2/1951 | Johnson | 144/225 |
| 2,870,807 | 1/1959 | Payzant | 144/224 |
| 3,388,020 | 6/1968 | Gates | 156/266 |
| 3,927,705 | 12/1975 | Cromeens et al. | 144/317 |
| 3,942,233 | 3/1976 | Cromeens | 29/200 |
| 4,248,280 | 2/1981 | Taylor | 144/3 |
| 4,500,385 | 2/1985 | Waggoner | 156/380 |
| 4,538,392 | 9/1985 | Hamar et al. | 52/582 |
| 4,833,855 | 5/1989 | Winter, IV | 52/592 |
| 4,941,521 | 7/1990 | Redekop et al. | 144/347 |
| 4,965,943 | 10/1990 | Adams | 33/758 |
| 5,005,619 | 4/1991 | Jensen | 144/91.2 |
| 5,113,632 | 5/1992 | Hanson | 52/385 |
| 5,237,870 | 8/1993 | Fry et al. | 73/588 |
| 5,576,082 | 11/1996 | Jarrett | 428/36.91 |
| 5,626,705 | 5/1997 | Winterowd et al. | 156/304.5 |
| 5,647,699 | 7/1997 | Martin et al. | 407/33 |

OTHER PUBLICATIONS

Wisconsin Knife Works "Fingerjoint Heads and Cutters", Bulletin 700 H.

Wisconsin Knife Works "Cutterheads, Knives & Finger Joint Tooling" Catalog and Technical Information.

Wisconsin Knife Works Industrial Cutting Tools 1998 Edition.

*Primary Examiner*—W. Donald Bray

*Attorney, Agent, or Firm*—Leydig, Voit & Mayer, Ltd.

[57] ABSTRACT

A finger joint cutting tool includes unitary finger joint cutter bits. Each cutter bit has a unitary body to provide several integrally formed finger cutting teeth for finger jointing wood materials. Preferably the body is formed by an electrical discharge machine (EDM) process to provide the cutting teeth without any pinchpoints between teeth. The cutter bit therefore does not include several separate stacked knives to provide the cutting teeth. The finger joint cutting tool includes a head having a predetermined axis of rotation. The head has a plurality of locating surfaces spaced radially about the head which receive the finger joint cutter bits at a constant diameter. Each cutter bit is unitary and has a planar cutting face capable of being sharpened. The cutting face includes a plurality cutting teeth having linear fingering edges extending radially between adjacent base and tip edges. Each of the base edges are located at the same radius relative to the axis. Likewise, each of the tip edges are located at the same radius relative to the axis. Each of the fingering edges are aligned at the same angle relative to the axis. The tips and the bases have the same axial width whereby the dimensions of the teeth are substantially equivalent to the dimensions of gaps defined between adjacent teeth.

18 Claims, 6 Drawing Sheets

UNITARY FINGER JOINT CUTTING BIT AND FINGER JOINT CUTTING HEAD INCORPORATING THE SAME

FIELD OF THE INVENTION

The present invention generally relates to finger jointing wood material, and more specifically to tools for finger jointing wood material.

BACKGROUND OF THE INVENTION

Finger joints are used in a wide variety of applications to mate two shorter segments of wood into one longer piece of wood. The reasons for finger jointing may be varied. For example, one goal of finger jointing may be to remove knots and defects to then produce usable longer pieces of wood. Another reason for finger jointing may be to produce a finished component that has a greater strength characteristic than ordinary wood. A properly finger jointed length of wood may have a strength factor greater than the same piece of wood that has not been finger jointed.

The preferred tool for forming finger joints is known today as the finger joint cutter head which utilizes sets of stack knives bolted on at radially spaced intervals about the cutter head. This technology was developed in the 1920's by the present assignee of the instant invention as exemplified by U.S. Pat. No. 1,718,325 for what is know today as the finger joint cutting head. Finger jointing has evolved since the 1920's in that better adhesives, closer tolerances and machining precision have improved greatly over the years to provide joints that have become shorter and stronger. The demand for finger jointing has increased as diminishing supplies of wood tell us that it makes good sense to make longer pieces from short ones whenever possible. However, the basic design of the finger joint cutting head has remained unchanged for the most part over seventy (70) years since the 1920's in which the first finger joint cutting head was developed by the present assignee, Wisconsin Knife Works, Inc. The finger joint cutting head developed by Wisconsin Knife Works, Inc. has been well accepted by industry and has become the standard as evidenced by several companies copying the basic stacked knife design.

Finger jointing requires that the profile being cut into the wood is both consistent and close fitting. Therefore it is important to keep the individual knives of each set (sometimes referred to as a "circle bit") sharp and well aligned. Great care must be taken to be sure that the cutter angle on each individual circle bit is maintained as the incorrect angle may produce strength problems in the resulting wood finger joint. For example, cutters that are ground too sharp produce wood fingers that are concave which in turn produces a joint that will either not glue up correctly or that will be visibly loose. Cutters that are ground too blunt will produce wood fingers that are concave which in turn produces a finger joint that is very tight or difficult to assemble. The alignment of the individual circle bits as well as the alignment of each set of circle bits on the cutter head is crucial for a good fitting joint. Misalignment of the circle bits or sets of circle bits can cause significant problems. For example, if the circle bits are misaligned, the fingers cut into the wood can either be trimmed too short or too long. When the cutter head removes too much material from the end of the wood stock, the joint will be tight at the sides of the fingers before the fingers are able to reach the bottom of the joint. This results in a visible gap at the end of the fingers while the sides of the joint are in contact with each other resulting in a weaker and less aesthetic finger joint. To remedy this problem, the finger joint cutting head must be readjusted so that the fingers are longer. If the fingers are trimmed too long, too much wood material is left on the fingers and the resulting joint "bottoms out" before the sides of the fingers are in contact with each other. This also results in strength problems. Again, the finger joint cutter head must be accurately set to ensure the perfect fit.

Often, finger jointing is accomplished with two different heads, one to cut the male end and the other to cut the female end to match such that the cut wood fingers interlock while providing a substantially smooth outer surrounding surface between adjoined boards. Thus, this requires high precision in both sharpening and setting the circle bits on both of the cutter heads. The number of knives on the bit can be adjusted to accommodate different width sizes of lumber.

SUMMARY OF THE INVENTION

It is therefore an general objective of the present invention to provide an improved tool for finger jointing wood materials.

It is a specific objective of the present invention to provide a more accurate and precise tool for finger jointing wood materials.

It is another specific objective of the present invention to provide a finger joint cutting tool that has easier and less laborious service maintenance.

Accordingly, the present invention provides a finger joint cutter bit that comprises a unitary body to provide several integrally formed cutting teeth for finger jointing wood materials. Preferably the body is formed by an electrical discharge machine (EDM) process to provide the cutting teeth. The cutter bit therefore does not include several separate stacked knives to provide the cutting teeth.

The present invention also provides an improved finger joint cutting head which includes a head having a predetermined axis of rotation. The head has a plurality of locating surfaces spaced radially about the head which receive the finger joint cutter bits. Each cutter bit is unitary and has a planar cutting face capable of being sharpened. A plurality cutting teeth formed in the outer surface of the bit intersect the cutting face to provide a continuous cutting edge without pinch points. The cutting edge includes linear fingering edges extending radially between adjacent base and tip edges. Each of the base edges are located at the same radius relative to the axis. Likewise, each of the tip edges are located at the same radius relative to the axis. Each of the fingering edges are aligned at the same angle relative to the axis. The tips and the bases have the same axial width whereby the dimensions of the teeth are substantially equivalent to the dimensions of gaps defined between adjacent teeth.

While the present invention is incorporated in a cutter bit that is initially much more costly than the stacked knife circle bits of a traditional finger joint cutter head and may not be as readily adaptable for several different width sizes of wood, the present invention has several significant advantages which makes the present invention the much more desirable tool for finger jointing wood material.

One advantage is the ease at which the tool is set up. The cutter bit can simply be located on a locating surface of the head and slid forward until the leading face of the bit contacts a stop. Then a clamp is tightened to secure the bit to the head. Advantageously, the cutting edges of the several bits are automatically aligned at a constant diameter. Another advantage is the ease at which periodic sharpening of the bit is accomplished with a consistently high degree of precision. The bevel of the bit will always remain the same no matter how much or often the cutting face is sharpened. All of the cutting teeth are simultaneously sharpened by simply grinding the cutting face of the bit. Because the cutting face is the most forward surface of the bit, the cutting faces of multiple bits are always aligned at spaced intervals regardless of how often the bits are sharpened.

It is an aspect of the present invention that the cutting angle of the unitary cutter bit can be much larger as compared with the traditional stacked knife or circle bit approach. This provides a better finish to the fingers cut into the wood material because the cutting teeth contact the wood at a much sharper angle. The tool can also be run at higher speeds than traditional finger joint tooling which reduces the chip load and wood "tear out" or alternatively increases the feed rates of wood and therefore the overall production rate.

Another advantage is that longer run times can be achieved because almost twice as much clearance can be designed into the tool as compared with traditional finger joint heads. In particular, the cutting teeth of each cutter bit spend less time in the grooves formed between fingers of the cut wood thereby reducing contact between metal and wood. Therefore, the tool runs cooler, cleaner, and results in a better finish. This also slows deterioration of the cutting edge and maintains a longer cutting edge life.

Another advantage is that the bit achieves less finger damage and less plugging of the tool. With prior finger joint tooling, slivers of wood would occasionally pack and wedge at pinch points between individual knives of the circle bit stack. This causes the knives to be slightly displaced relative to each other which can cause cutter breakage or finger joint quality problems in mating wood pieces. With the present invention, pinch points are eliminated and therefore the distance between adjacent cutting teeth is always constant. Moreover, the cutter bits of the present invention can be wire EDM machined which can achieve a more precise tool. The increased precision can achieve an accumulated tolerance across two inches of fingers that is under 0.0005 inches. Higher precision improves the quality, consistency and strength of the cut finger joints.

Other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

Figure 1:
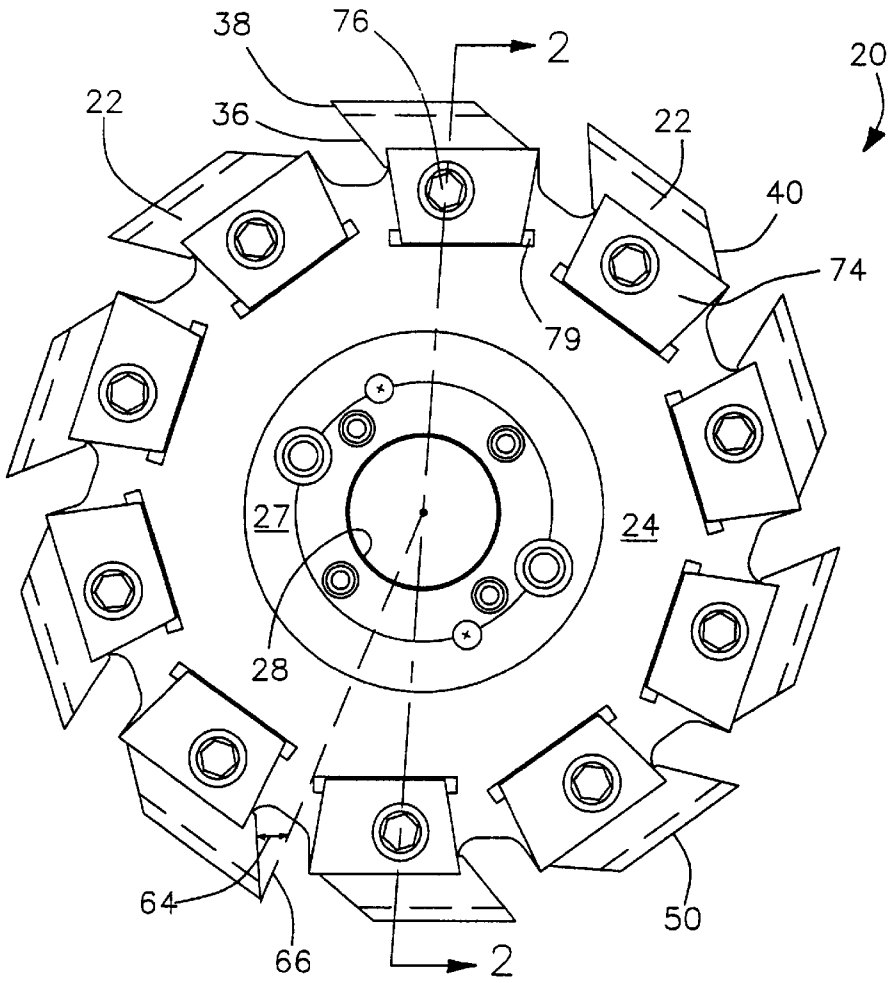
FIG. 1 is a top view of a finger joint cutting tool according to a preferred embodiment of the present invention.
Figure 2:
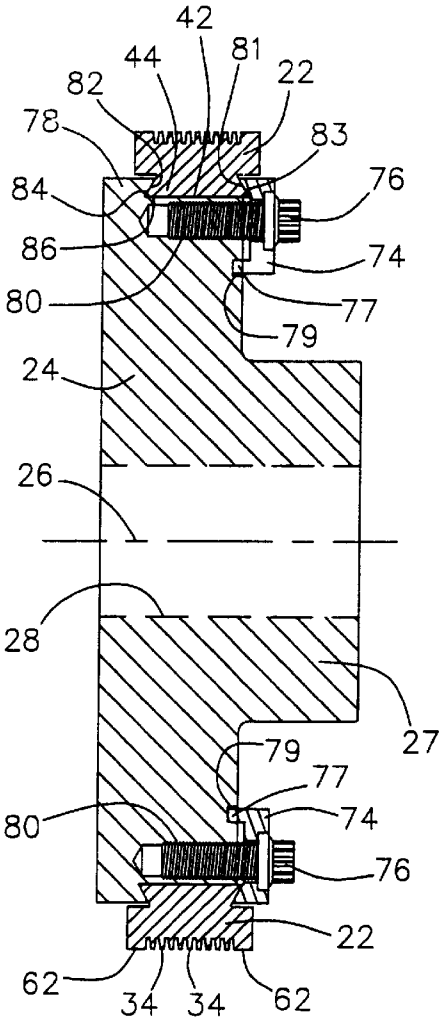
FIG. 2 is a cross section of FIG. 1 taken about line 2—2.

Referring to FIGS. 1 and 2, the present invention is embodied in a finger joint cutting tool 20 for cutting fingers into wood boards and other wood material such as composites like MDF particle board and oriented strand board. The tool 20 includes a plurality of finger joint cutter bits 22 clamped at spaced intervals about a head 24. The head 24 has a central hub 27 that provides a centrally located hole 28 that mounts to the spindle of a rotary power drive in a usual manner. The head 24 is adapted to be rotated at high speeds about a predetermined center axis 26. As such, the bits 22 also have the same axis 26 of rotation. During rotation of the head 24, the bits 22 sequentially remove material from wood boards that are feed past the head 24 in a conventional manner.

Figure 5:
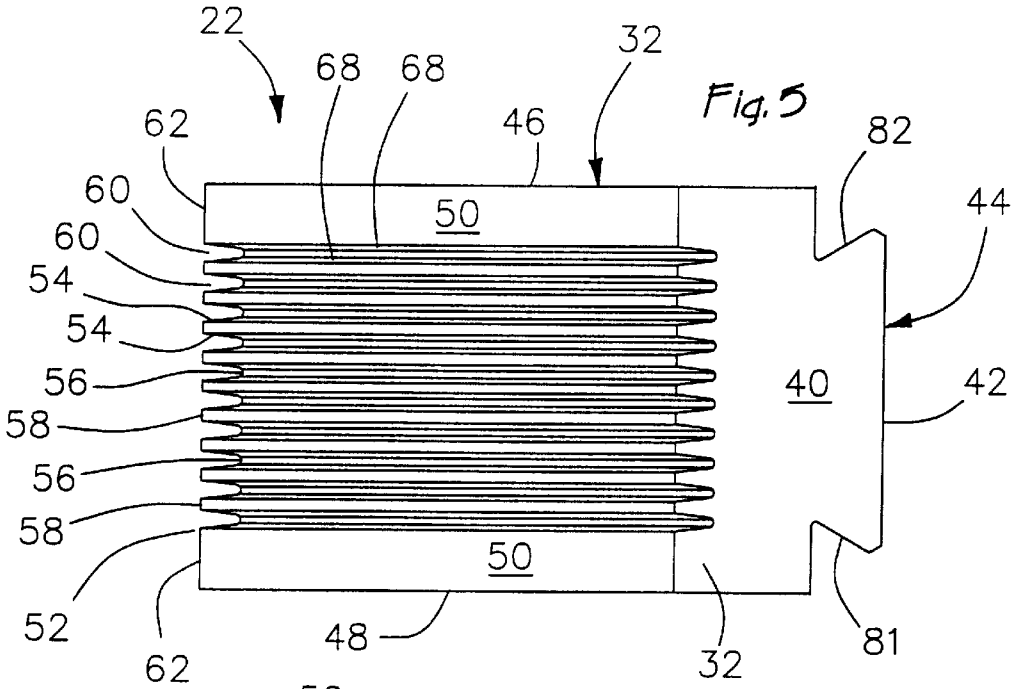
FIGS. 3–5 are side, end and top views for a cutting bit used in the tool of FIG. 1.
Figure 3:
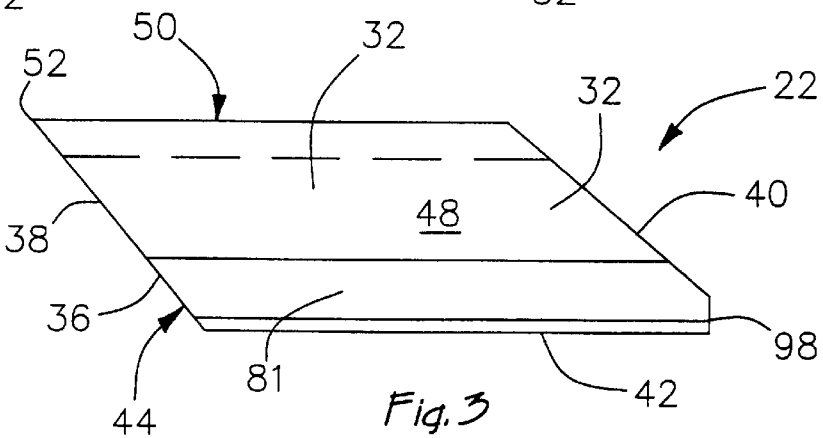
Figure 4:
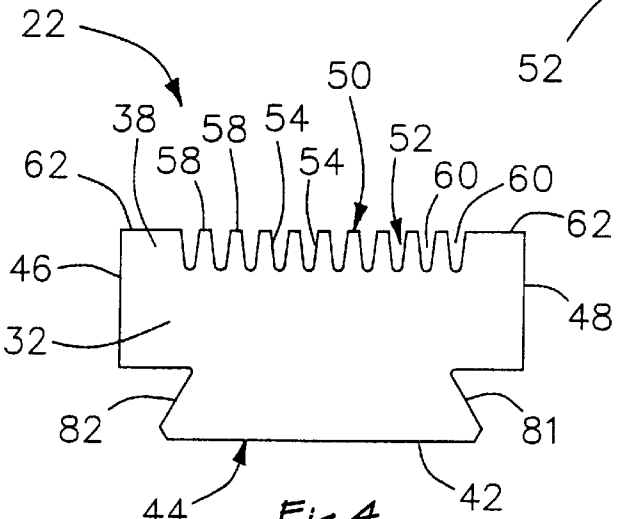
Figure 6:
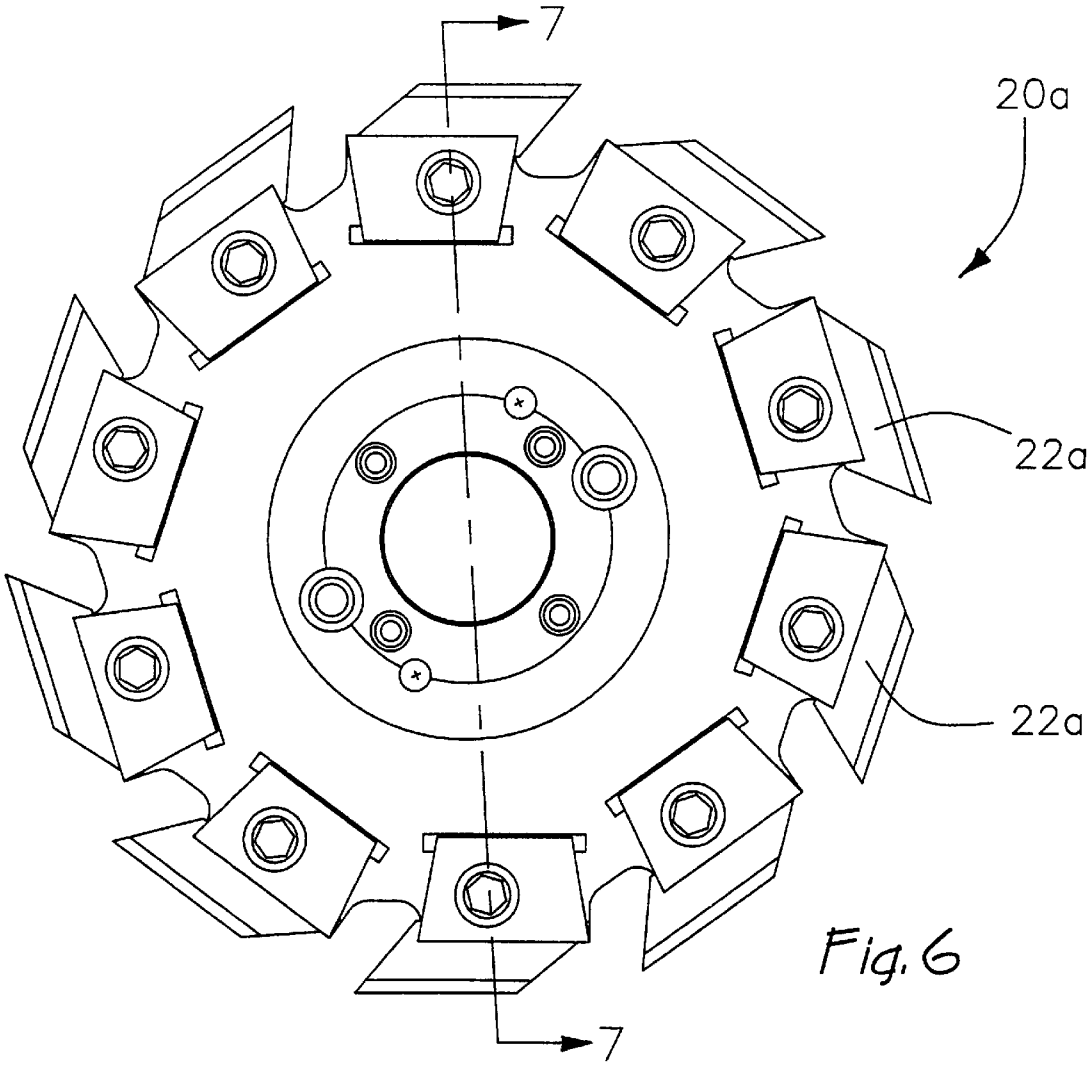
FIG. 6 is a top view of a matching finger joint cutting tool for that illustrated in FIGS. 1 and 2.
Figure 7:
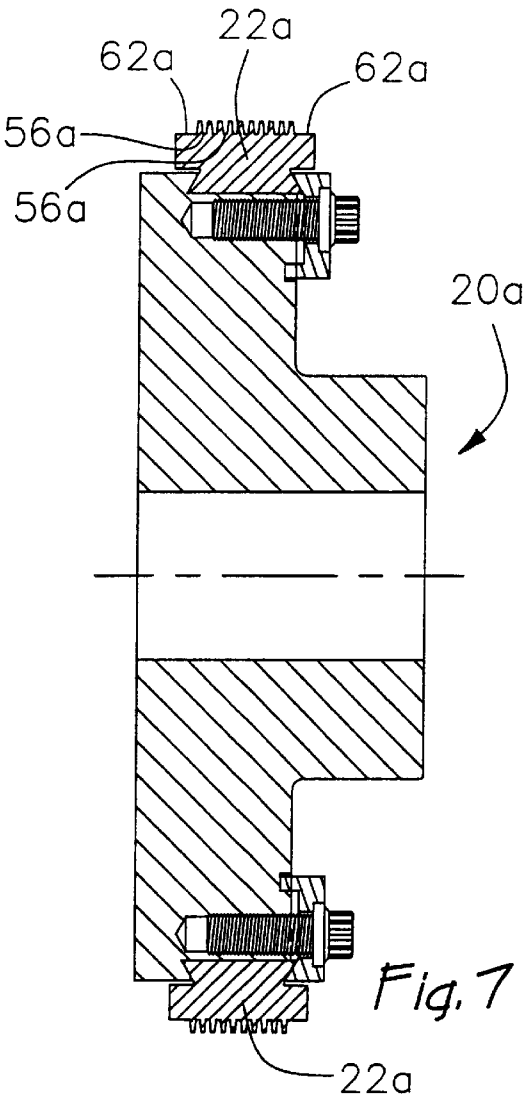
FIG. 7 is a cross section of FIG. 3 taken about line 7—7.
Figure 10:
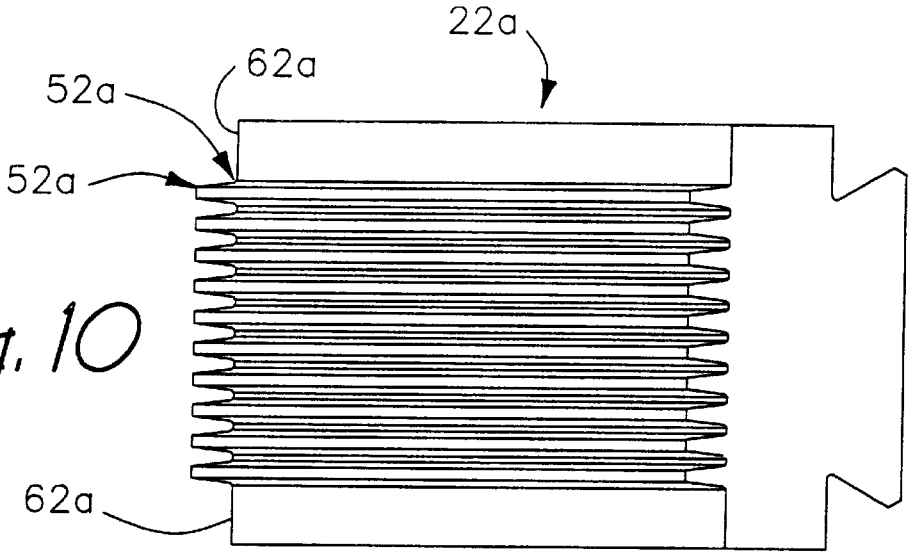
FIGS. 8–10 side, end and top views for a cutting bit used in the tool of FIG. 3.
Figure 8:
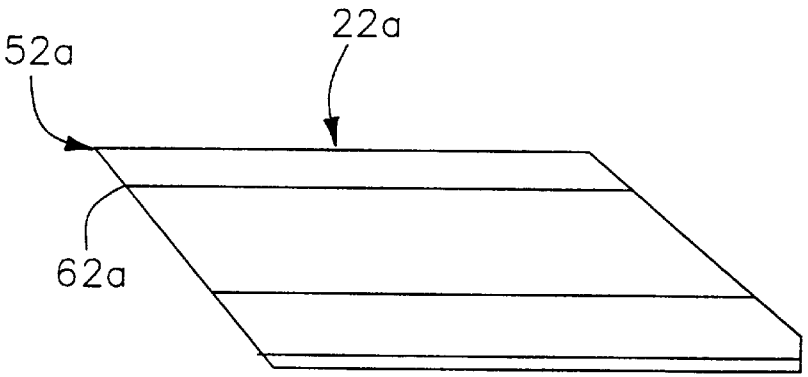
Figure 9:
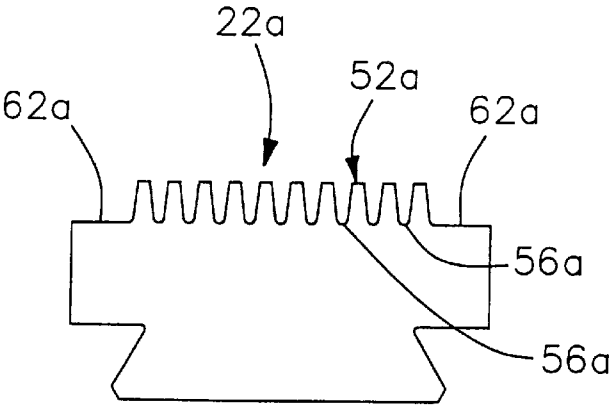

In accordance with the present invention, each finger joint cutter bit 22 is a single unitary body 32 that integrally provides several formed cutting teeth 34. Referring to FIGS. 3–5, each body 32 has a leading end 36 providing a cutting face 38 and a trailing end 40. The unitary body 32 has a mounting surface 42 provided by a dovetail portion 44, side surfaces 46, 48, and an exposed peripheral outer surface 50, each extending traversely between leading and trailing ends 36, 40. The side surfaces 46, 48 extend traversely between the mounting surface 42 and outer surface 50, with the mounting surface 42 being located radially inward from the outer surface 50. Preferably, the body 32 formed by wire electrical discharge machining (EDM) to provide a high degree of precision. Using existing EDM technology, an accumulated tolerance across two inches of teeth of under 0.0005 inches can be achieved. This is a significantly higher degree of precision than what can be accomplished using traditional stacked knife circle bits. Higher precision improves the quality, consistency and strength of the cut finger joints as the fingers cut into the wood more precisely interlock in more substantially complete contact. In a less preferred embodiment the teeth 34 could be formed by a grinding or other acceptable method. The teeth 34 are formed in the outer surface 50 and preferably extend completely between leading and trailing ends 36, 40.

Figure 13:
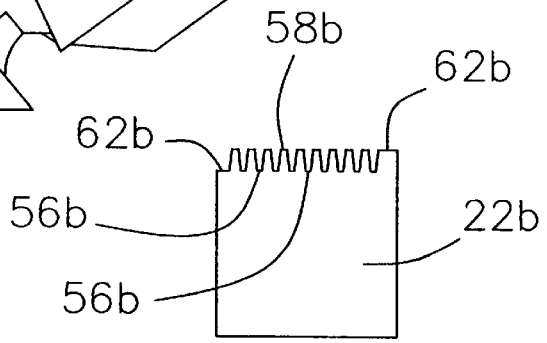
FIG. 13 is an end view of a cutter bit according to an alternative embodiment of the present invention.

The teeth 34 intersect the cutting face 38 to provide a continuous cutting edge 52 lying in the plane of the cutting face 38. The geometric configuration and precision of the cutting teeth 34 is critical for ensuring that the resulting fingers cut into wood properly interlock and closely mate in substantial complete contact for both aesthetic and strength purposes. Accordingly, the cutting edge 52 comprises linear fingering edges 54 extending radially relative to the axis 26 between adjacent inward base edges 56 and outward tip edges 58. The base edges 56 are aligned with each other and are each located at the same radius relative to the axis 26. Likewise, the tip edges 58 are aligned with each other and are each located at the same radius relative to the axis 26 as well as to the mounting surface 42. Each of the fingering edges 54 are also aligned at the same angle relative to the axis 26. Importantly, the tip edges 58 have the same axial width as the base edges 56 so that the dimensions of the teeth 34 are substantially equivalent to the dimensions of gaps 60 defined between adjacent teeth. This ensures that the fingers cut into one wood board closely interlock with fingers cut into another wood board in substantially complete contact. Substantially complete contact between interlocking fingers is necessary for coupling the boards permanently together with glue or other adhesive material. There may be slight dimensional differences between gaps 60 and teeth 34 related to the configuration of the base and tip edges 56, 58 (although as previously mentioned, the tip edges 58 have the same axial width as the base edges 56). Preferably, the tip edges 58 are linear as shown to provide a sharp cutting tip edge 58. Preferably, the base edges 56 are curved to provide strength to better prevent teeth 34 from breaking off of the bit 22. Alternatively, the base edges 56*b* may also be linear as illustrated in the alternatively embodiment of FIG. 13. It is not necessary for the base edges 56 to engage or cut the wood as a conventional subsequent trimming operation can be done to trim the length of the fingers such that the outer tips of the fingers are planar and the base wall of the grooves between fingers are planar as well.

Finger joint cutting tools are significantly different than other types of cutting tools in that finger joint tools require symmetrically sized teeth to meet the width sizes of wood boards intended to be finger jointed. As such a preferred embodiment of the tool 20 has a practical range of dimensions which defines the tool as the wood fingerjointing type. In particular, the practical range of widths for the tip edges and base edges is between about 0.03 inches and about 0.35 inches. The practical range of tip index distance (comprising a distance between adjacent tips) is between about 0.1 and about 0.27 inches. The practical effective radial length (portion which engages the wood) of the teeth 34 of the bit is between about 0.15 inches and about 1.2 inches sufficient for cutting corresponding length fingers into wood material.

The cutting edge 52 also preferably includes a pair of shoulder cutting edges 62 at respective ends of the teeth 34 such that the cutting teeth 34 are disposed intermediate the shoulder cutting edges 62. Each shoulder cutting edge 62 is wider than each of the tip edges 58 of the teeth 34 for cutting wider end shoulders into wood boards. The formed shoulders prevents thin and weak feather segments from forming on the exposed surfaces of finger-jointed boards which could easily break off and cause aesthetic defects.

It is an advantage that the continuous nature of the cutting edge 52 eliminates pinch points which can collect wood slivers between individual teeth as is the case with traditional stacked knife circle bits. This maintains the precise distance between adjacent teeth 34 resulting in more precise fingers being cut into the wood. The cutting face 38 is also planar which allows the face 38 to be readily sharpened by a grinding tool. By grinding the cutting face 38 of the bit, each of the cutting teeth 34 are simultaneously sharpened. Each of the teeth 34 are also automatically aligned with a high degree of precision. It is an advantage that the bevel of the bit will always remain the same no matter how much or often the cutting face 38 is sharpened. Thus, periodic sharpening of the bit is easily accomplished with a high degree of precision.

In accordance with an aspect of the present invention, the preferred embodiment provides a cutting angle 64 of the unitary cutter bit 22 that is selectively larger as compared with the traditional stacked knife approach. The cutting angle 64 is defined as the angle at which the cutting edge 52 or cutting face 38 intersects a radius line 66 extending from the center axis 26 as shown in FIG. 1. In particular, the cutting angle 64 can be greater than about 25° which has not been accomplished on prior art finger joint heads. It has been found that a cutting angle 64 between about 30° and about 40° provides the maximum benefit. Although cutting angles 64 greater than 45° may be achievable, such angles may cause weakness in the teeth 34 or result in actually faster deterioration of the cutting edge 52. The increased cutting angle 52 provides a better finish to the fingers cut into the wood material because the cutting teeth 34 have a sharper cutting edge 52 and contact the wood at a much sharper angle.

The preferred embodiment also reduces the portion of the teeth 34 that enters the formed grooves between the wood fingers, thereby reducing heat production, friction, deterioration of the cutting edge 52 and wear of the cutter bit 22. In particular, the outer surfaces 50 of the bits 22 comprise planar surfaces 68 extending rearward from the teeth 34. In comparison, traditional stacked knife circle bits have a circular or curved outer periphery profile for support and to allow for sharpening of the tool which results in a substantial portion of the teeth entering the grooves between formed wood fingers. It is an advantage almost twice as much clearance can be designed into the tool 20 as compared with traditional finger joint heads. In particular, the cutting teeth 34 of each cutter bit spends less time in the grooves formed between fingers of the cut wood thereby reducing contact between metal and wood. Therefore, the tool runs cooler, cleaner, and results in a better finish. This also slows deterioration of the cutting edge 52 and maintains a longer cutting edge life. The tool 20 can also be run at higher speeds than traditional finger joint tooling which reduces the chip load and wood "tear out" or alternatively increases the feed rates of wood and therefore the overall production rate.

The clamping mechanism which secures bits 22 to the head 24 includes a movable clamp 74 that is selectively tightened by a screw 76 or other fastener against the dovetail portion 44 of the bit 22. The dovetail portion 44 is adapted to be held tightly between the clamp 74 and a radially outward projecting support brace 78 integrally formed with the body of the head 24. The screw 76 is fastened into a tapped threaded hole 80 in the head 24. The clamp has a projection 77 which is received into a slot 79 in the head 22 to secure and align the clamp 74 to the head 22. The dovetail portion 40 includes beveled guide walls 81, 82 which intersect the mounting surface 42 at an oblique angle. The guide walls 81, 82 cooperate with corresponding guide walls 83, 84 of the clamp 74 and the support brace 78, respectively, to seat the mounting surface 42 against a locating surface 86 at the outer periphery of the head 24 when the clamp 74 is tightened. The head 22 includes multiple locating surfaces 86 spaced at radial intervals about the head 24 for assisting in locating the cutter bits 22 at spaced intervals and at a constant diameter about the head 24. The locating and mounting surfaces 86, 42 of the preferred embodiment are planar to allow the bit 22 to be slide forward or rearward to a desired position to locate the teeth 34 of the multiple bits 22 at precise spaced radial intervals to ensure that each bit removes about the same amount of wood material during each pass. The locating and mounting surfaces 86, 42 could also be corrugated or other profiled configuration in a less preferred embodiment.

Figure 11:
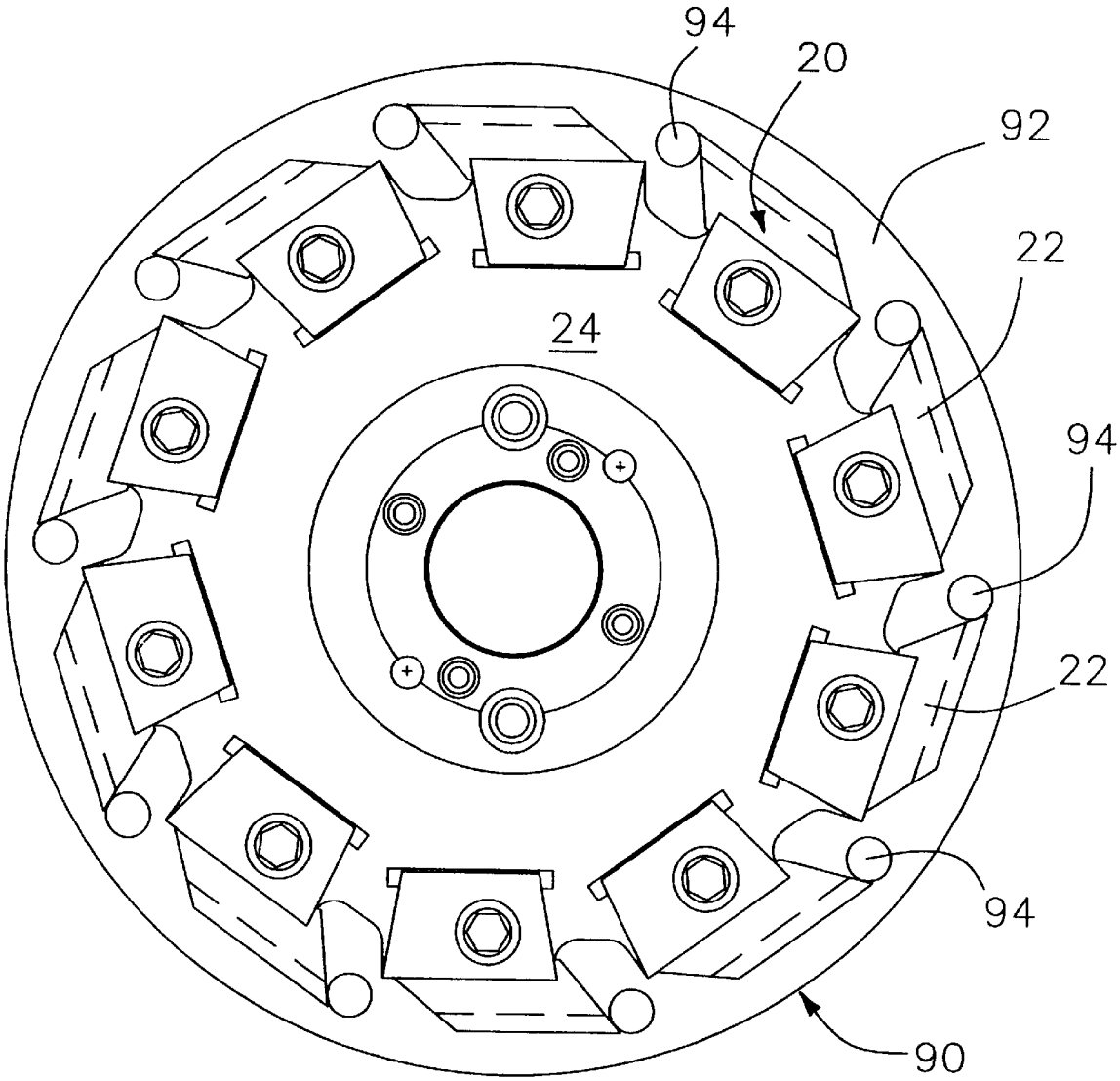
FIG. 11 is a top view of the finger joint cutter head of FIG. 1 on an associated alignment tool.
Figure 12:
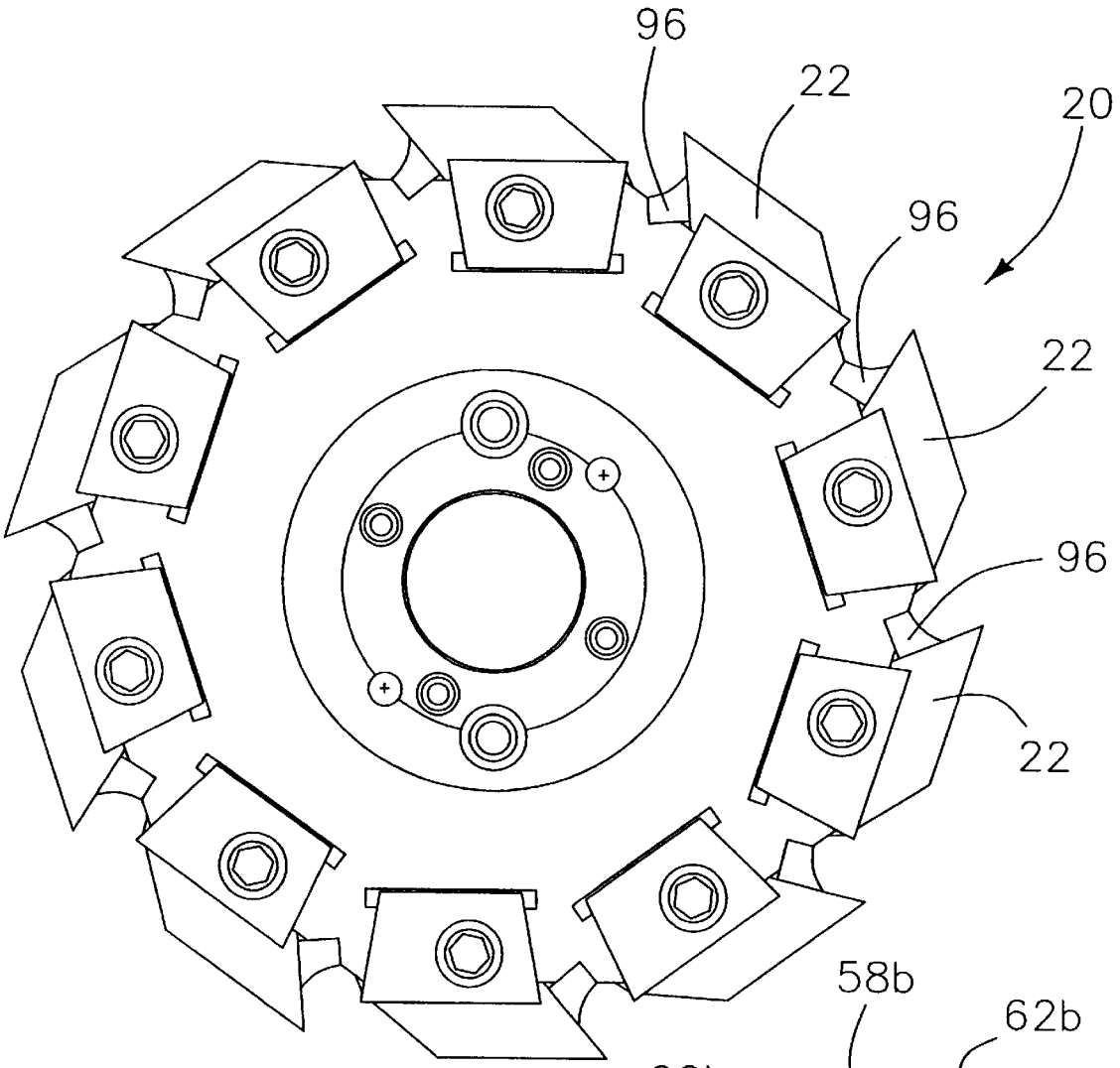
FIG. 12 is a top view of a cutter head according to another embodiment of the present invention.

Two different preferred alignment mechanisms are illustrated in FIGS. 11 and 12. FIG. 11 illustrates a separate aligning tool 90 that includes a support plate 92 having alignment posts 94 spaced at precise radial intervals. The tool 20 is placed on the aligning tool 90 and the bits 22 are slid forward on the respective locating surfaces 86 such that the cutting faces 38 of the bits 22 align flush or in contact with the alignment posts 94. Then, the clamps 74 are tightened to secure the bits 22 to the head 24. This allows the bits 22 to be sharpened on the head 24 with a face grinder. The locating surfaces 86 ensure that the cutting edge 52 of each bit has the same diameter with a high degree of precision. Advantageously, this results in each bit performing an equal amount of work and removing an equal amount of material during each cut. Another mechanism illustrated in FIG. 12 are fixed alignment stops 96 at the forward ends of the locating surfaces 86. The alignment stops 96 may be integrally formed with the head 24 or a separate piece fastened to the head 22. Each alignment stop 96 stops the forward movement of each bit 22 relative to the locating surface 86 to align the cutting faces of each of the bits 22 at spaced radial intervals. The bits 22 may be removed from the head 22 for sharpening. This mechanism also similarly achieves constant diameter of the cutting edges 52 of the several bits.

The end trailing end 40 of each bit 22 also provides a grinding surface 98 where material can be removed if necessary to better balance the tool 20 about the axis 26 of rotation.

The tool 20 illustrated in FIGS. 1–2 is adapted to be used with the matching tool 20*a* illustrated in FIGS. 3–4. The matching bits 22*a* on the matching tool 20*a* having a cutting edge 52*a* whose pattern interfits the pattern of the first bits 22 to cut matching interlocking fingers into a mating wood board. This can be seen in comparing FIGS. 2 and 4 where shoulder edges 62 of the first head 22 are aligned with the tip edges 58 while the shoulder edges 62*a* of the matching head 24*a* are aligned with the base edges 56*a*. However, it will be appreciated that the shoulder edges 62 do not need to be aligned with the base or tip edges 56, 68 and can be alternatively provided at a point intermediate therebetween to provide what is know to those skilled in the art as a half-shoulder joint. Another alternative is a reversible bit 22*b* illustrated in FIG. 13 in which one shoulder edge 62*b* is aligned with the tip edges and one shoulder edge 62*b* is aligned with the base edges. A single head incorporating reversible bits 22*b* may be used by reversing alternate pieces of wood board stock that has been cut.

The initial fixed cost of providing the bits 22 of the present invention is considerably more expensive than that of traditional stacked knife circle bits. However, over the lifespan of the tool, it has been found that the expense of the present invention is comparable or even less than the cost of traditional stacked knife circle bits. It has also been found that if a tooth breaks off from the bit, the bit is still operational. Specifically, it has been found that the next sequential bit will remove more material to compensate for the broken off tooth. Moreover, the much increased precision and increased cutting angle achievable with the present invention as aforementioned makes the tool 20 of the present invention a much more desirable tool and accomplishes a higher quality and more consistent finger joint.

All of the references cited herein, including patents, patent applications and publications are hereby incorporated in their entireties by reference. While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A unitary finger joint cutter bit for mounting to a finger joint cutter head for rotation about an axis, comprising:

a unitary body having leading and trailing ends, the body having a mounting surface, an outer surface and side surfaces extending transversely between leading and trailing ends, the side surfaces extending transversely between the mounting surface and the outer surface, the body having a plurality of teeth formed into the outer surface intersecting the leading end along a continuous cutting edge without pinch points, the leading end intersecting the mounting surface at an obtuse angle and being planar such that it is capable of being sharpened, the cutting edge comprising fingering edges extending linearly between adjacent base and tip edges, the tip edges being aligned with each other, the base edges being aligned with each other, each of the fingering edges having the same angle relative to the mounting surface, the tip edges and the base edges having the same axial width whereby the dimensions of the teeth are substantially equivalent to the dimensions of gaps defined between adjacent teeth.

2. The unitary finger joint cutter bit of claim 1 wherein the width of each of the tip and base edges is between about 0.03 inches and about 0.35 inches, and wherein each bit has a tip index comprising a distance between adjacent tips of between about 0.1 and about 0.27 inches, and wherein each of the teeth of the bit has an effective length of between about 0.15 inches and about 1.2 inches sufficient for cutting corresponding length fingers into wood material.

3. The unitary finger joint cutter bit of claim 2 wherein each of the tip edges are linear and intersect the respective fingering edges at sharp corners, and wherein the base edges are curved.

4. The unitary finger joint cutter bit of claim 2 wherein the cutting edge includes a pair of shoulder edges, the teeth disposed intermediate the shoulder edges, each shoulder edge having a width greater than the width of the base and tip edges for preventing formation of thin feather segments in exposed surfaces of wood material.

5. The unitary finger joint cutter bit of claim 1 wherein the leading end of the bit is aligned at a cutting angle relative to a radius line from the axis that is greater than about 25 degrees.

6. The unitary finger joint cutter bit of claim 5 wherein the cutting angle is between about 30 degrees and about 40 degrees.

7. The unitary finger joint cutter bit of claim 1 wherein the teeth have a planar outer peripheral profile that intersects the leading end at an acute angle to thereby minimize contact between metal and wood during cutting operations.

8. The unitary finger joint cutter bit of claim 1 wherein the unitary body includes a dovetail extending transversely between leading and trailing ends, the dovetail providing the mounting surface and including beveled walls intersecting the mounting surface at oblique angles.

9. A finger joint cutting tool for finger-jointing wood material, comprising:

a head having a predetermined axis of rotation, the head having a plurality of locating surfaces spaced radially about the head; and a plurality of finger joint cutter bits secured to the head at respective locating surfaces, each cutter bit including a unitary body having leading and trailing ends, the body having a mounting surface, an outer surface and side surfaces extending transversely between leading and trailing ends, the side surfaces extending transversely between the mounting surface and the outer surface, the mounting surface seated on one of the locating surfaces, the body having a plurality of teeth formed into the outer surface intersecting the leading end along a continuous cutting edge without pinch points, the leading end providing a planar cutting face capable of being sharpened, the cutting edges of the respective bits being aligned at spaced intervals about the head, the cutting edge of each bit including linear fingering edges extending radially between adjacent base and tip edges, each of the base edges being located at the same radius relative to the axis, each of the tip edges being located at the same radius relative to the axis, each of the fingering edges being aligned at the same angle relative to the axis, the tip edges and the base edges having the same axial width whereby the dimensions of the teeth are substantially equivalent to the dimensions of gaps defined between adjacent teeth.

10. The finger joint cutter tool of claim 9 wherein the width of each of the tip and base edges is between about 0.03 inches and about 0.35 inches, and wherein each bit has a tip index comprising a distance between adjacent tips of between about 0.1 and about 0.27 inches, and wherein each of the teeth of the bit has an effective radial length of between about 0.15 inches and about 1.2 inches sufficient for cutting corresponding length fingers into wood material.

11. The finger joint cutter tool of claim 10 wherein each of the tip edges are linear running parallel to the axis and intersecting the respective fingering edges at sharp corners, and wherein the base edges are curved.

12. The finger joint cutting tool of claim 9 wherein the teeth of each bit have a planar outer peripheral profile that intersects the leading end at an acute angle to thereby minimize contact between metal and wood during cutting operations.

13. The finger joint cutter tool of claim 9 wherein the cutting face of each bit is aligned at a cutting angle relative to a radius line from the axis that is greater than about 25 degrees.

14. The finger joint cutter tool of claim 13 wherein the cutting angle is between about 30 degrees and about 40 degrees.

15. The finger joint cutter tool of claim 9 wherein the cutting edge of each bit includes a pair of shoulder edge, the cutting teeth disposed intermediate the shoulder cutting edge, each shoulder edge having a width greater than the width of the base and tip edges for preventing formation of thin feather segments in exposed surfaces of wood material.

16. The finger joint cutter tool of claim 9 wherein the head includes a plurality of clamps for securing the bits to the head, each clamp being releasable to allow the cutter bit to be slid linearly relative to the locating surface.

17. The finger joint cutter tool of claim 16 wherein each bit includes a dovetail extending transversely between leading and trailing ends, the dovetail providing the mounting surface and including beveled walls intersecting the mounting surface at oblique angles, the head providing a support brace each the clamp, the clamp being movable towards and away from the support brace to hold the dovetail therebetween, the support brace and clamp having corresponding alignment walls cooperating with the beveled walls, the alignment walls engaging the beveled walls when the clamp is tightened to seat the mounting surface against the locating surface.

18. The finger joint cutter tool of claim 17 further comprising means for stopping the forward movement of the cutting face of each cutter bit when the clamp is released to locate each of the cutting face at precise radial intervals about the cutter head.

* * * * *